US011434916B2

(12) United States Patent
Labuda

(10) Patent No.: US 11,434,916 B2
(45) Date of Patent: Sep. 6, 2022

(54) BATHROOM VENTILATION SYSTEM

(71) Applicant: John G. Labuda, Hoffman Estates, IL (US)

(72) Inventor: John G. Labuda, Hoffman Estates, IL (US)

( * ) Notice: Subject to any disclaimer, the term of this patent is extended or adjusted under 35 U.S.C. 154(b) by 124 days.

(21) Appl. No.: 17/153,236

(22) Filed: Jan. 20, 2021

(65) Prior Publication Data

US 2021/0140442 A1 May 13, 2021

Related U.S. Application Data

(63) Continuation-in-part of application No. 16/501,805, filed on Jun. 8, 2019, now abandoned.

(51) Int. Cl.

| | |
|---|---|
| ***F04D 25/08*** | (2006.01) |
| ***F24F 7/007*** | (2006.01) |
| ***F24F 11/77*** | (2018.01) |
| *F04D 19/00* | (2006.01) |

(52) U.S. Cl.

CPC ..... *F04D 25/088* (2013.01); *F24F 7/007* (2013.01); *F04D 19/002* (2013.01); *F24F 11/77* (2018.01); *F24F 2221/14* (2013.01)

(58) Field of Classification Search

CPC ..... F04D 25/088; F04D 19/002; F24F 7/007; F24F 7/013; F24F 7/02; F24F 7/025; F24F 11/77; F24F 2221/14

USPC ..... 4/209 R

See application file for complete search history.

(56) References Cited

U.S. PATENT DOCUMENTS

| | | | | |
|---|---|---|---|---|
| 3,974,754 A * | 8/1976 | Powlesland | ..... | F24F 7/06 454/251 |
| 4,362,922 A * | 12/1982 | Anderson | ..... | F24F 7/013 454/186 |
| 5,862,981 A | 1/1999 | Weng | | |
| 2007/0294809 A1 | 12/2007 | Yin et al. | | |

FOREIGN PATENT DOCUMENTS

| | | | | |
|---|---|---|---|---|
| EP | 2965016 B1 * | 6/2018 | ..... | F24F 13/24 |

* cited by examiner

*Primary Examiner* — Tuan N Nguyen
(74) *Attorney, Agent, or Firm* — Christopher J. Scott

(57) ABSTRACT

A room ventilation system ventilates a structurally enclosable first room as exemplified by a restroom. A second room adjoins the first room with a shared wall therebetween. A fan assembly is mounted within the shared wall such that the airflow from the fan assembly is directed toward the first room. A vent cover in downstream adjacency to the fan assembly has first louvres for re-directing airflow from the fan assembly in a first oblique, downward direction. A vent cover in upstream adjacency to the fan assembly has second louvres for re-directing airflow from the second room in a second oblique, downward direction. Circuitry, in electrical communication with a power source and the fan motor assembly, includes a switch for enabling the user to selectively power the fan motor thereby directing airflow from the second room into the first room for replacing air within the first room.

13 Claims, 14 Drawing Sheets

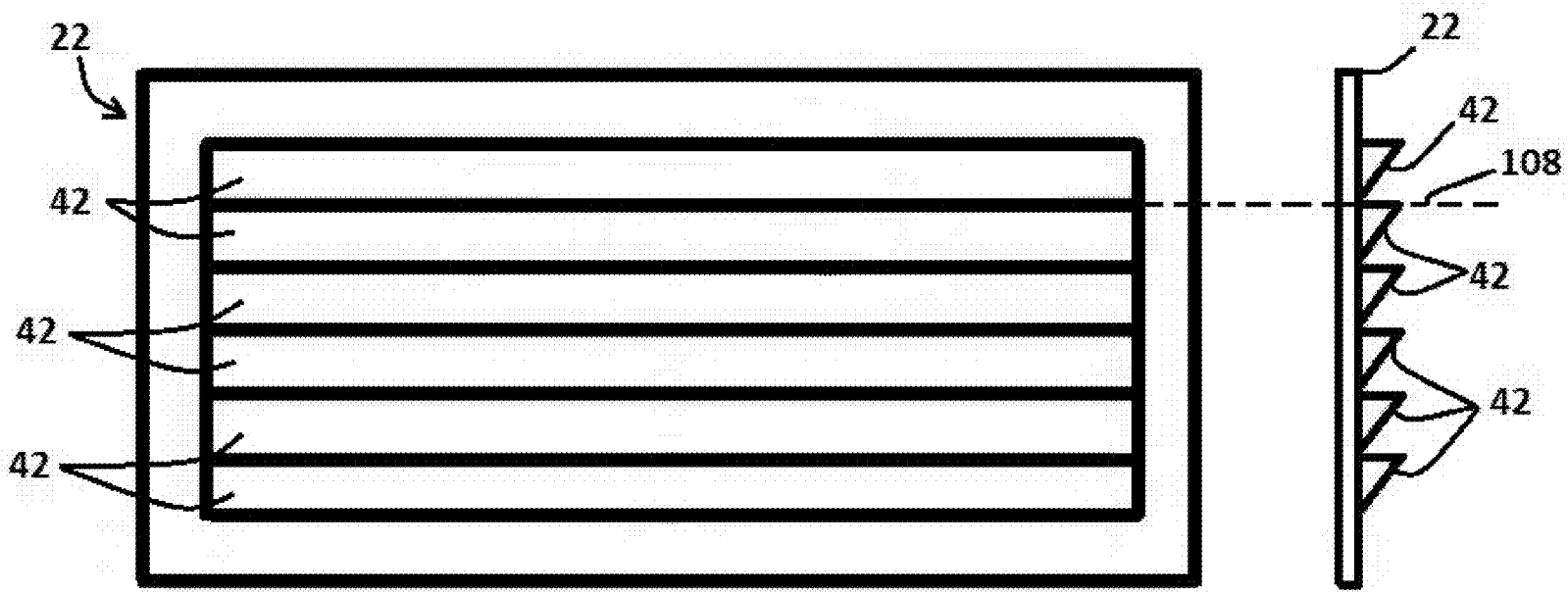
FIG. 18
FIG. 19
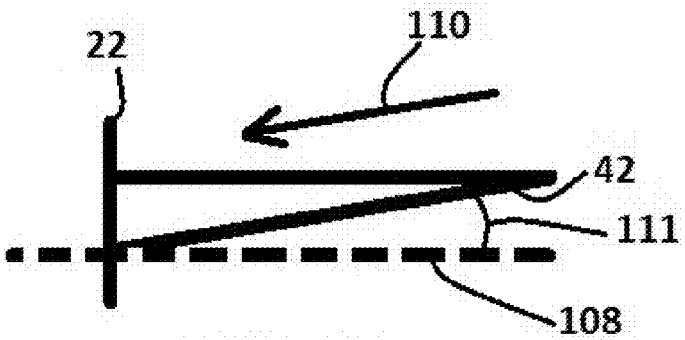
FIG. 20

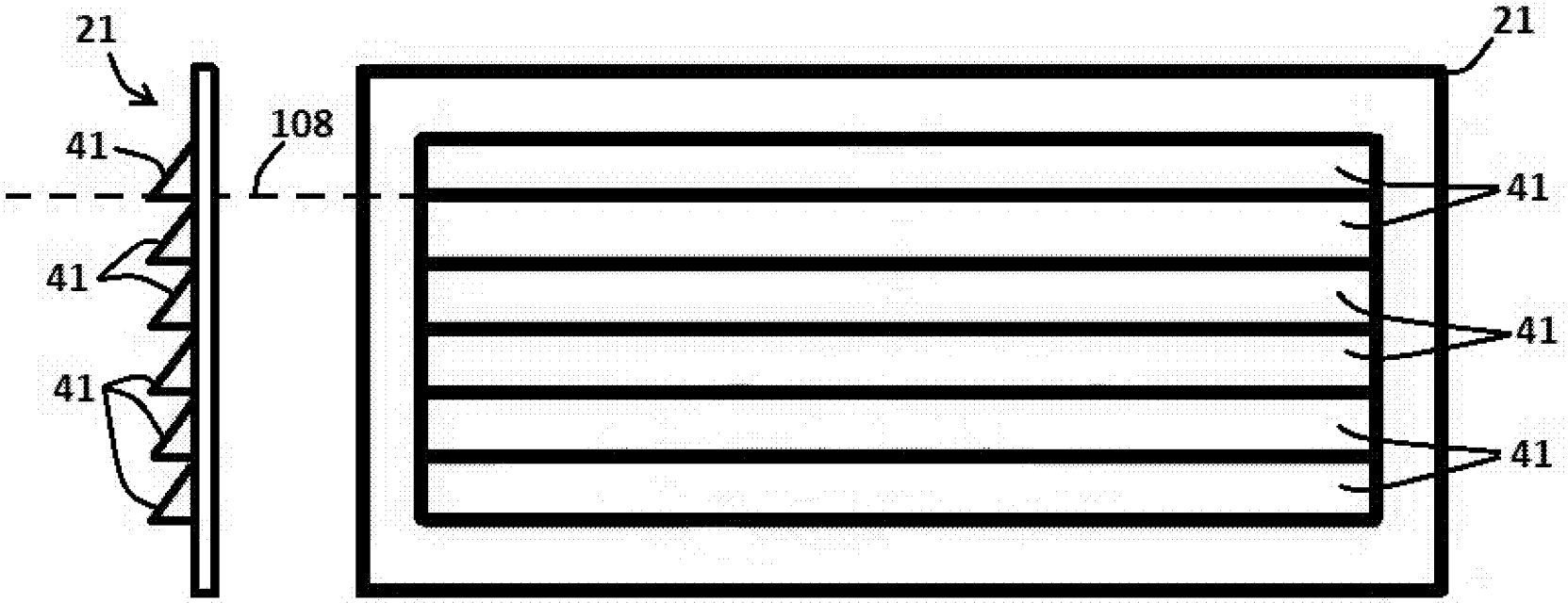
FIG. 21
FIG. 22
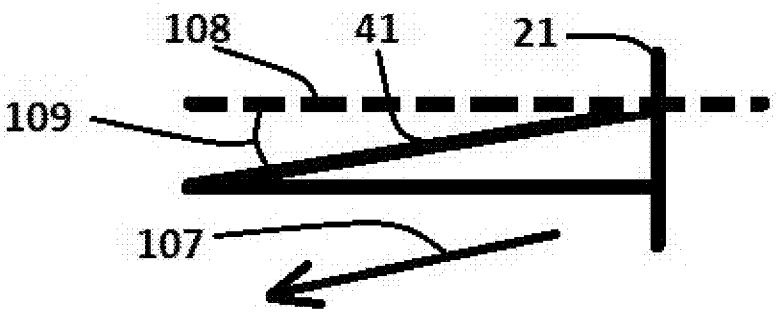
FIG. 23

BATHROOM VENTILATION SYSTEM

PRIOR HISTORY

This application is a Continuation-in-Part patent application claiming the benefit of pending U.S. patent application Ser. No. 16/501,805 filed in the United States Patent and Trademark Office (USPTO) on 8 Jun. 2019, the specifications, claims, and drawings of which are hereby incorporated by reference thereto.

FIELD OF THE INVENTION

The present invention generally relates to heating and ventilation systems for occupant rooms, and more particularly to a ventilation system incorporating specific structural components to enhance ventilation of outfitted rooms, and in the process control ambient temperatures in those rooms.

BRIEF DESCRIPTION OF THE PRIOR ART

A common problem associated with newly acquired living quarters is poor ventilation of certain rooms within the living quarters and particularly restrooms within the living space. Moisture, mold, and cold temperatures are typically prevalent in such installations, and space or other heaters alone are insufficient to properly remedy the problem. A system or kit enabling a user to outfit or retrofit existing installations with a particular set of components to improve ventilation is a perceived need in the art. Such a system or kit, when retrofit into existing construction, solves the problem of high humidity or moisture within the room, improves temperature characteristics during extreme temperature fluctuations, and helps support a healthier, more comfortable living environment.

U.S. Pat. No. 5,862,981, issued to Weng, discloses a Ventilation Control Device for a Bathroom and is believed to be exemplary teaching in the field of room ventilation art. The '981 Patent describes a ventilation control device disposed in a bathroom, which ventilation control device operates according to particular methodology then considered novel and inventive as compared to the state-of-the-art at that time. The ventilation control device has a switch board, a controller connected to the switch board, a sensor connected to the controller, and a fan motor connected to the controller. The controller outputs a signal to initiate the fan motor to change a rotating speed.

US Patent Application Publication No. 2007/0294809, authored by Yin, et al. describes a Bathroom Ventilating Device. The bathroom ventilating device by Yin, et al. includes one or more air inlet openings formed in a ceiling of a bathroom for introducing an air into the bathroom, and an air evacuating device disposed on a floor of the bathroom for evacuating odor and moisture from the bathroom. An air drawing device is attached to the ceiling of the bathroom and includes a fan aligned with the air inlet opening of the ceiling for drawing the air into the bathroom for effectively circulating and drawing the air out of the bathroom and for effectively circulating and introducing the fresh air into the bathroom and for effectively removing the odor and the moisture from the bathroom.

SUMMARY OF THE INVENTION

Having considered these prior art citations, the prior art perceives a need for a bathroom ventilation system including particularized components of finer distinction. Central to the practice of the present invention is a preferred axial fan assembly and a pair of vent covers that cooperate with the unique structural characteristics of the axial fan assembly. The pair of vent covers comprise a downstream vent cover and an upstream vent cover relative to the airflow velocity from the axial fan assembly parallel to the axis of its rotation. The axial fan assembly may be operated continuously all year long and in doing so supplies a constant supply of dry, warm air to a bathroom, the preferred target room for ventilation.

The axial fan assembly installation includes a number of components, including a flexible metal conduit FMC squeeze connector, which connector is fastened to a rigid Type C conduit body. A three-wire conductor set within a metallic armored steel flexible conduit is attached to the flexible metal conduit FMC squeeze connector. The three wires from this arrangement are connected at an electrical 1900 box, with the black wire connected to the fan speed controller switch, the white wire connected to the neutral wire, and the green wire is connected to the body of the electrical 1900 box.

In a preferred installation, the axial fan assembly is installed above a restroom door within a shared wall, and "pumps" air from an adjoining room into the restroom such that the intaking air remains close to the ceiling at a rate of roughly 50 cubic feet per minute. When coupled with a restroom state of the art exhaust assembly, the system is capable of ventilating air at roughly 60 cubic feet per minute. By particularly angling the warm, dry air from the adjoining room as it enters the bathroom, high humidity and moisture within the restroom quickly disappears thereby retarding the growth of mold and mildew within the outfitted room. The axial fan assembly is particularly quiet (19 dB) and thus does not disturb users, contributing to enhanced sleep patterns.

The axial fan assembly according to the present. invention runs on 115 Volts, AC, 4 W, 50/60 Hz with a maximum speed of 1450 rotations per minute. The noise rating is 19 decibels and is capable of moving ventilating 50 cubic feet minute. Costs to continuously run the fan 24 hours a day, 7 days a week for a year are calculated to be less than $3.00 USD. The circuitry supporting the axial fan assembly is protected with a dine-delay ¼ Amp, 115 VAC fuse, and includes a fan velocity slider switch control (115 VAC) to control the rotations per minute (rpm) from 0 rpm up to 1450 rpm. The preferred dimension of the fan housing is 4 ¾ inches by 4 ¾ inches, with a thickness of roughly 1 ½ inches. The fan guards or vent covers are roughly 7 ¼ inches by 6 ¼ inches.

BRIEF DESCRIPTION OF THE DRAWINGS

Other features and objectives of the subject invention will become more evident from a consideration of the following brief descriptions of patent drawings.

FIG. 18 is an enlarged anterior plan view of the vent cover otherwise depicted in FIG. 15.

FIG. 19 is an edge view of the vent cover otherwise depicted in FIG. 18, and showing a series of louvres obliquely angled upwardly relative to the plane of the singular vent cover.

FIG. 20 is a two-dimensional diagrammatic depiction showing a preferred angle of inclination of the louvre(s) otherwise depicted in FIG. 19.

FIG. 21 is an edge view of the right vent cover otherwise depicted in FIG. 14, showing a series of louvres obliquely angled downwardly relative to the plane of the right vent cover.

FIG. 22 is an enlarged anterior plan view of the right vent cover otherwise depicted in FIG. 14.

FIG. 23 is a two-dimensional diagrammatic depiction showing a preferred angle of inclination of the louvre(s) otherwise depicted in FIG. 21.

DETAILED DESCRIPTION OF THE PREFERRED EMBODIMENT

Figure 1:
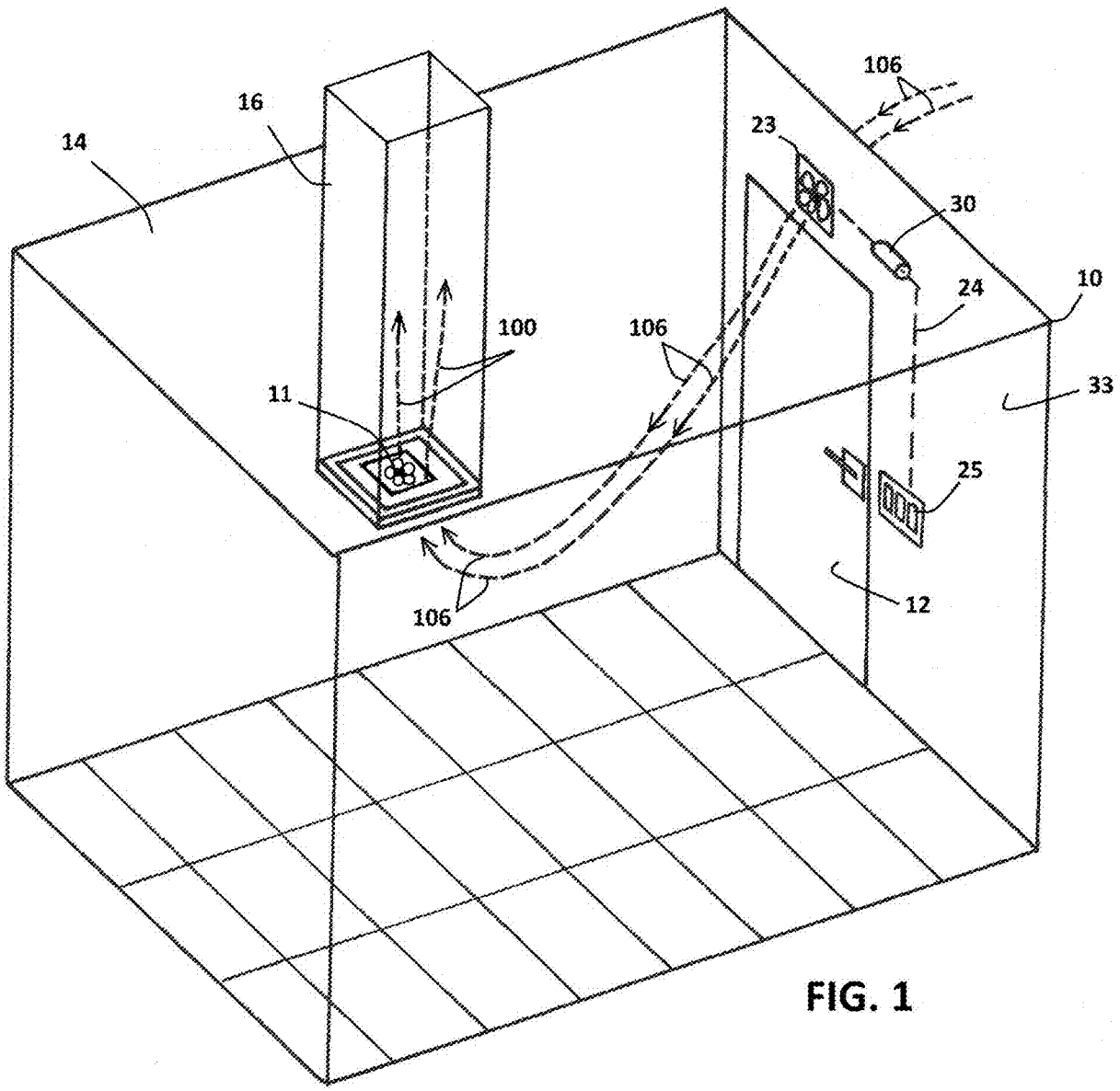
FIG. 1 is a perspective diagrammatic overview depiction of the ventilation system according to the present invention showing a structurally enclosed, first room outfitted with axial fan assemblies for simultaneously forcing air from the structurally enclosed, first room and forcing air into the structurally enclosed, first room.
Figure 2:
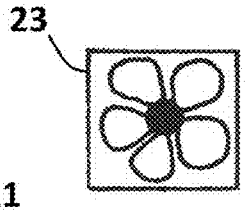
FIG. 2 is a simplistic front plan view depiction of an axial fan assembly as an exemplary first component of the ventilation system according to the present invention.
Figure 3:
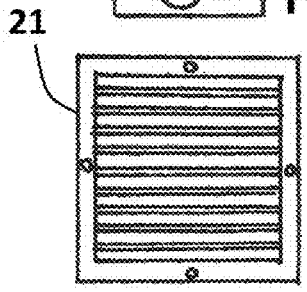
FIG. 3 is a simplistic front plan view of a louvered vent cover as an exemplary second component of the ventilation system according to the present invention.
Figure 9:
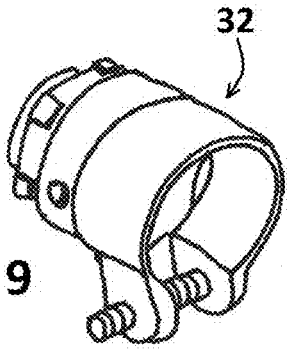
FIG. 9 is a simplistic perspective view of a flexible metal conduit clamp connector as an exemplary seventh component of the ventilation system according to the present invention.
Figure 4:
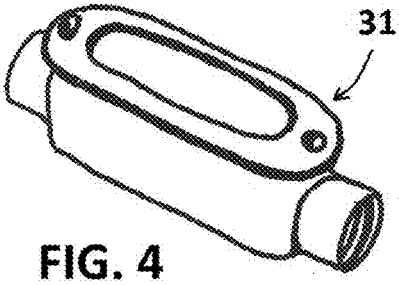
FIG. 4 is a simplistic perspective view of a conduit body with cover as an exemplary third component of the ventilation system according to the present invention.
Figure 8:
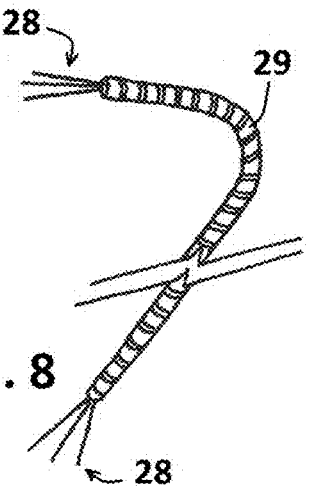
FIG. 8 is a simplistic perspective view of a 3-sire flexible metallic sheath conduit with a break therein to depict varying length thereof as an exemplary sixth component of the ventilation system according to the present invention.
Figure 5:
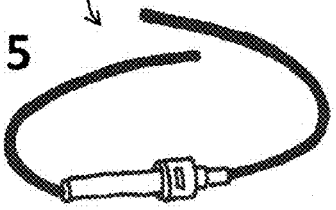
FIG. 5 is a simplistic perspective view of an in-line fuse assembly as an exemplary fourth component of the ventilation system according to the present invention.
Figure 7:
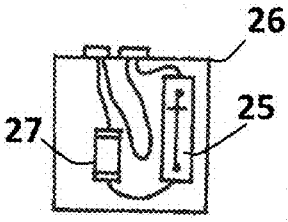
FIG. 7 is a simplistic front plan depiction of an electrical box configuration showing a fuse and slider switch within the box for selectively powering and controlling fan speed of a first axial fan assembly of the ventilation system according to the present invention.
Figure 6:
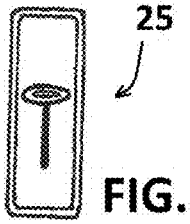
FIG. 6 is a simplistic front plan view of a fan speed control slider switch as an exemplary fifth component of the ventilation system according to the present invention.

Referring now to the drawings with more specificity, the following specifications generally describe a system of ventilation or ventilation system for ventilating a structurally enclosed, first target room 10 as generally depicted in FIG. 1. As discussed hereinabove, restrooms within an occupant dwelling or workspace, even when outfitted with state-of-the-art exhaust fans 11, often suffer from poor ventilation resulting in a room characterized by high humidity or moisture content as well as undesirable or inferior ambient air temperature(s) and quality, particularly during colder months of the year.

Space heaters have proven to be poor solutions to the problems here noted, particularly when utilized in restrooms given the exposure of heating elements utilized thereby in close proximity to high moisture content within the room. Separately installed space heaters further take up already limited space within the room becoming obstacles and tending to decrease the user's ability to safely use the facility. It is further noted that the entryway into a restroom is often outfitted with a door 12, which door 12 is often kept in a closed state so as to prevent the poor air quality of the room from readily entering adjoining rooms. The target room outfitted according to the present invention may thus be considered a structurally enclosable first room as at 10 in FIG. 1.

Figure 10:
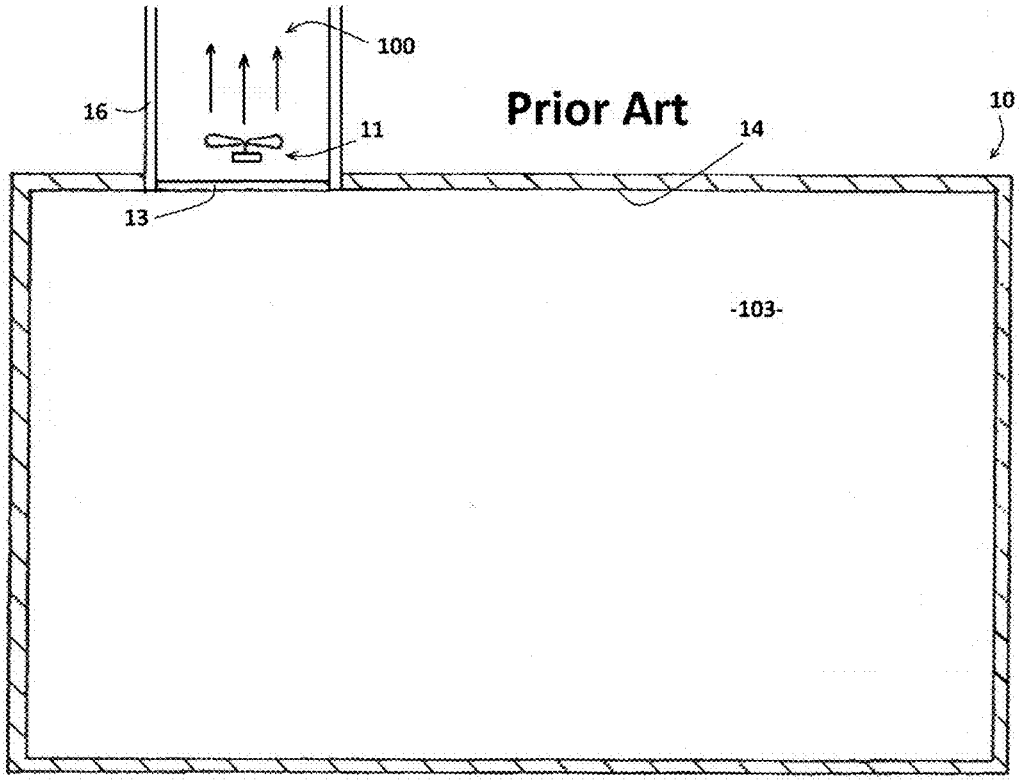
FIG. 10 is a cross-sectional type diagrammatic depiction of a Prior Art room outfitted with a ceiling-based exhaust fan assembly.
Figure 11:
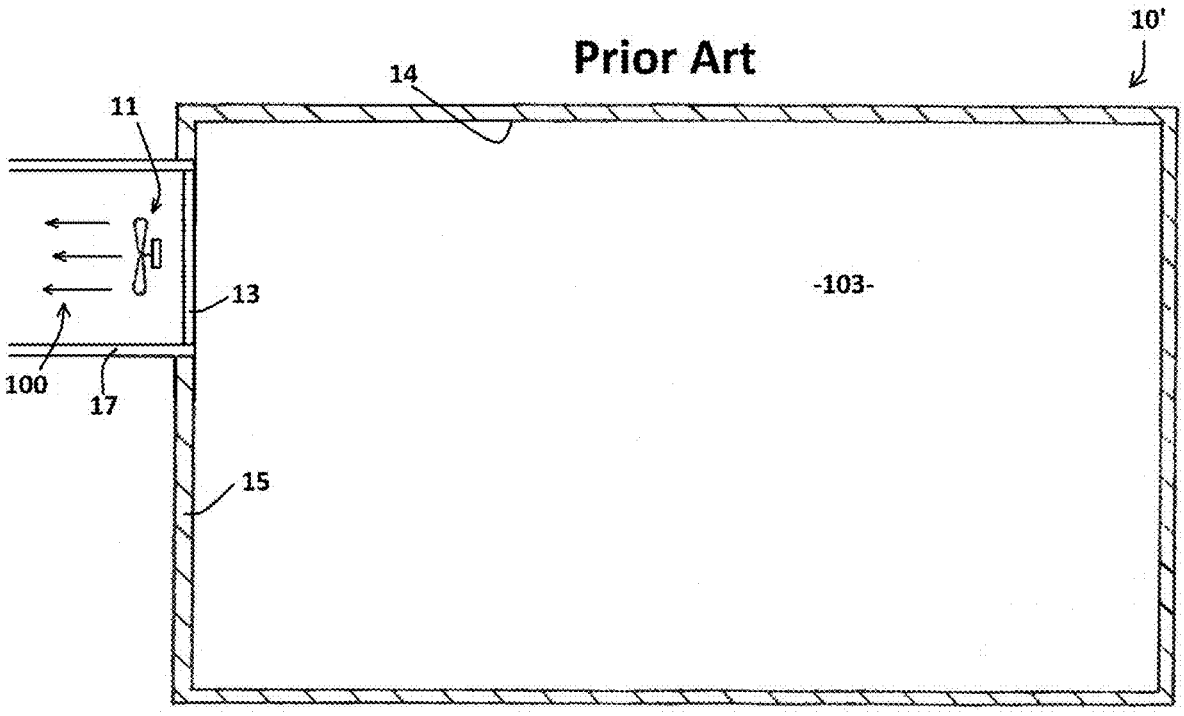
FIG. 11 is a cross-sectional type diagrammatic depiction of a Prior Art room outfitted with a wall-based exhaust fan assembly.

Comparatively referencing FIGS. 1, 10, and 11, the reader will there consider a structurally enclosed (air-permeable), first target room. FIGS. 10 and 11, in particular, comparatively depict Prior Art generic, structurally enclosed first rooms as at 10 and 10'. The structurally enclosed first room 10 is a Prior Art first room outfitted with a ceiling-based state-of-the art exhaust fan assembly as at 11. The structurally enclosed first room 10' is a Prior Art first room outfitted with a wall-based state-of-the art exhaust fan assembly 11.

The outfitted or target first room exemplified by rooms 10 and 10' according to the present invention is believed to essentially define a first cubic space as at 103, and is preferably outfitted with a first ventilation assembly as exemplified by exhaust fan assembly 11. The first ventilation assembly directs or exhausts air as at 100 from within the first cubic space 103 out of the first cubic space 103, which air has a first air quality that is relatively inferior as compared to the air quality of adjoining room(s) as judged by the user and thus requires particular ventilated replacement by the ventilation system according to the present invention.

The reader will note that rooms 10 and 10' with exhaust fan assemblies 11 are typically also outfitted with a vent cover 13 situated over the vent formed in either the ceiling 14 or the exhaust wall 15 through which airflow 106 may exhaust as at 100. The exhausting airflow 100 is typically conveyed through a chimney 16 or similar other exhaust ductwork 17 away from the room(s) 10/10'. Even when outfitted with state-of-the-art exhaust fan assemblies 11, ventilation characteristics within the room are poor, particularly when the door 12 is closed as is often desired. To remedy the perceived need in the art, the present invention contemplates directing desirable or relatively superior air quality of an adjoining second room into the first target room for enhancing the ventilation thereof and controlling temperature characteristics therewithin.

Figure 12:
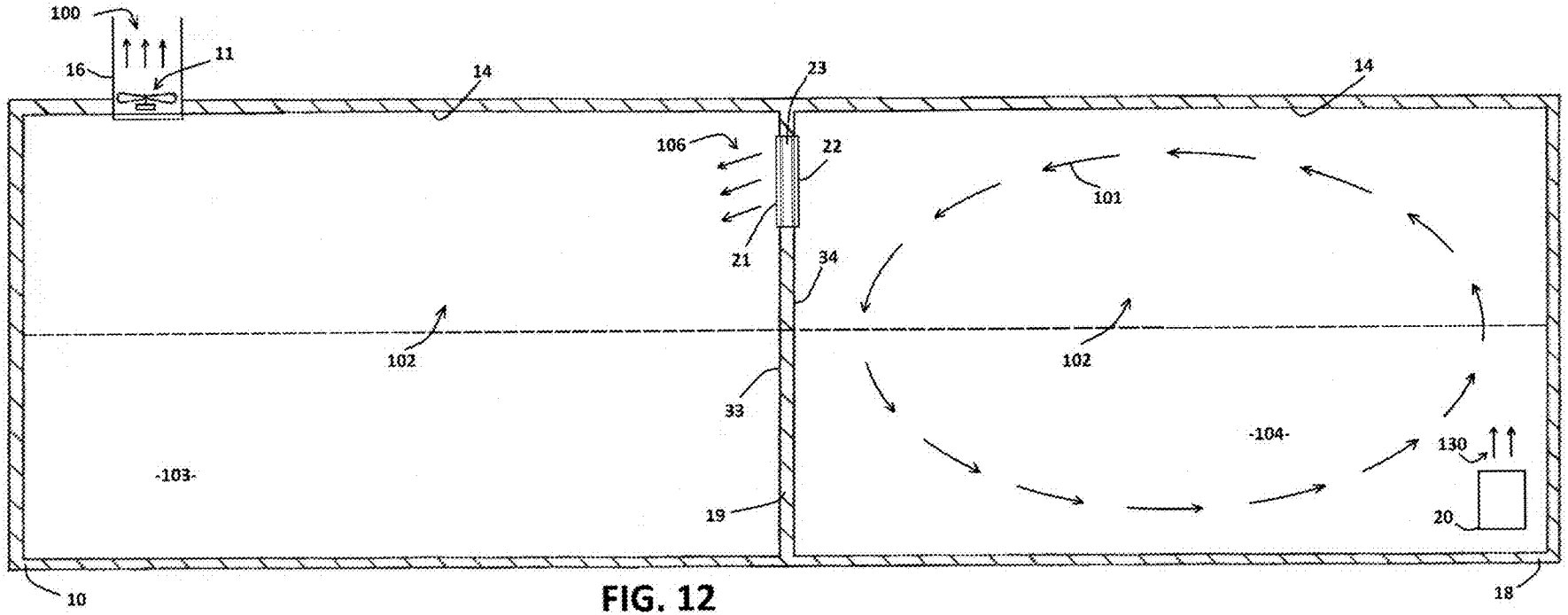
FIG. 12 is a cross-sectional type diagrammatic depiction of the Prior Art or first room otherwise depicted in FIG. 10 adjoining a second room having a shared wall therebetween with an axial fan assembly according to the present invention installed in the shared wall for exhausting air from the second room into the first room, the second room comprising a convective heat current.
Figure 13:
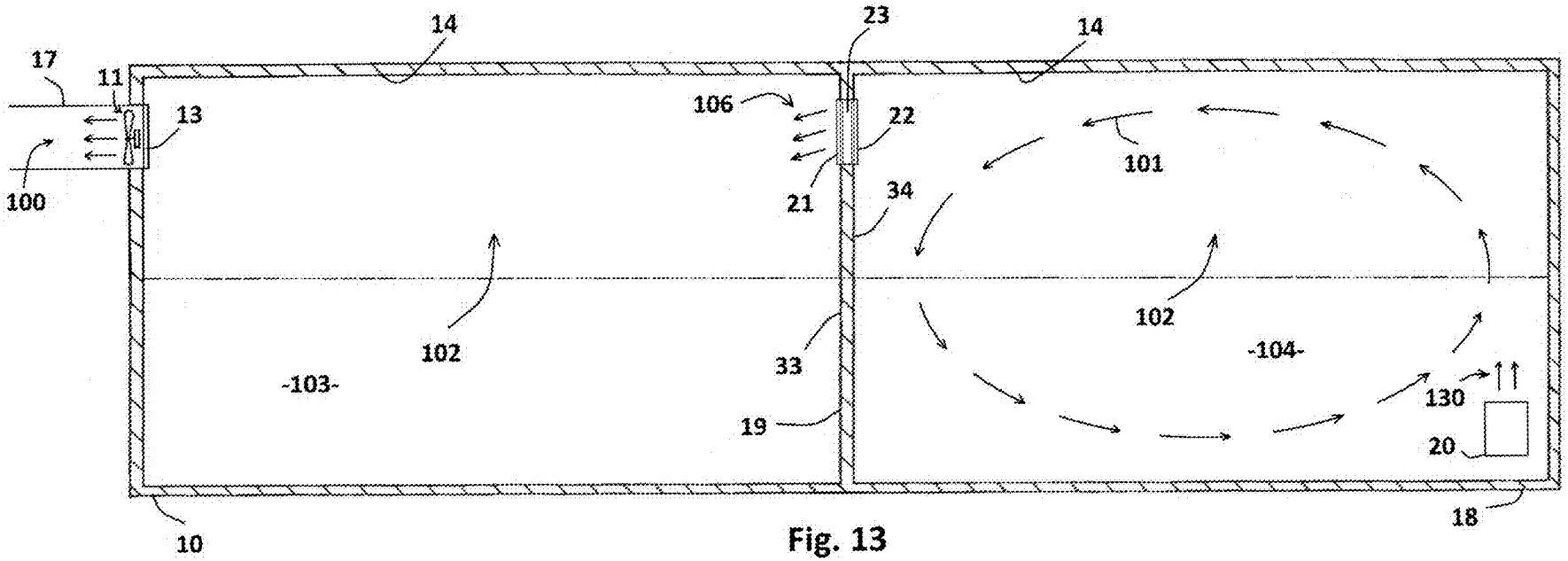
FIG. 13 is a cross-sectional type diagrammatic depiction of the Prior Art or first room otherwise depicted in FIG. 11 adjoining a second room having a shared wall therebetween with an axial fan assembly according to the present invention installed in the shared wall for exhausting air from the second room into the first room, the second room comprising a convective heat current.

Comparatively referencing FIGS. 12 and 13, the reader will there consider the Prior Art first rooms 10 and 10' adjoining a second room as at 18 and having a shared wall 19 therebetween. In a preferred implementation according to the present invention, the adjoining second room 18 preferably comprises a circulating forced air or convective heat current as generically depicted and referenced at 101 within the room 18 as generated at 130 from a forced air or convective heat source as generically depicted and referenced at box 20.

Forced air and/or convective heat current(s) 101 generally attempt to cycle heat from within a relatively heated upper ambient temperature zone as at 102 so as to better heat lower portions of the room 18 as so outfitted. The second room 18 according to the present invention is believed to essentially adjoin the structurally enclosed, first room 10 or 10' and share a wall therewith. The room(s) 10 and/or 10' and the room 18 are on either sides of the shared structural wall 19. The shared structural wall 19 preferably comprises a first room surface as at 33 within the structurally enclosed, first room 10 or 10' and a second room surface as at 34 within the second room 18. The second room 18 defines a second cubic space as at 104, which second cubic space 104 having air within of a second air quality relatively superior (e.g. dryer and warmer) to the first air quality.

Figures 14, 15:
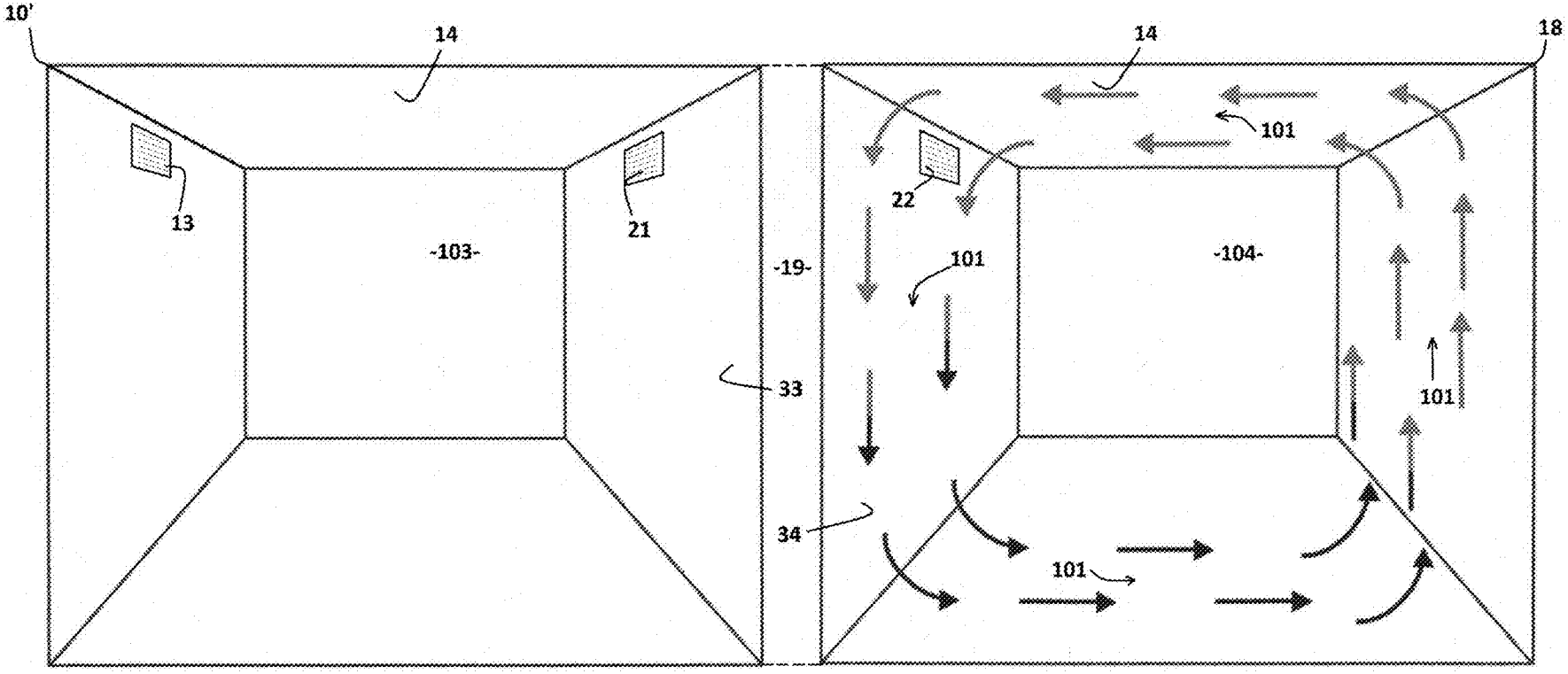
FIG. 14 is a perspective type diagrammatic depiction of a first room outfitted with opposed vent covers reflective of the first room as otherwise depicted in FIG. 13, the left vent cover covering a vent outlet and the right vent cover covering a vent inlet from an adjoining second room.
FIG. 15 is a perspective type diagrammatic depiction of a second room outfitted with a singular vent cover reflective of the second room as otherwise depicted in FIG. 13 with a convective heat current being depicted, the singular vent cover covering a vent outlet.

Comparatively referencing FIGS. 14 and 15, the reader will there respectively consider a Prior Art first room 10' and an adjoining second room 18 with an exemplary forced air or convective heat current as at 101. The Prior Art first room 10' is outfitted with a vent cover as at 13 and a first vent cover 21 according to the present invention. The adjoining second room 18 is outfitted with a second vent cover 22 according to the present invention. Installed within the shared wall 19 and intermediate the first vent cover 21 and the second vent cover 22 is a preferred axial fan assembly 23 according to the present invention as more particularly depicted and referenced in FIGS. 12 and 13. It is contemplated that the first vent cover 21, the second vent cover 22, and the preferred axial fan assembly 23 are central to the practice of the present invention.

Comparatively referencing FIGS. 1-9, the reader will there consider a number of components that support operation of the preferred axial fan assembly 23 as relatively simplistically depicted. In this regard, the preferred axial fan assembly 23 is preferably installed within the shared wall 19 preferably above the door 12 at an upper portion of the shared wall 19 as generally depicted in FIG. 1. Power is basically supplied to the preferred axial fan assembly 23 by way of electrical communications as at 24 between the axial fan assembly 23 and a wall-mounted switch as at 25. The wall-mounted switch 25 is preferably a slider switch operable at 115 VAC to control the rotational speed of the impeller assembly from 0 rotations per minute up to a maximum of 1450 rotations per minute.

The slider switch 25 is preferably mounted an at electrical box 26 installed within a wall exemplified by the shared wall 19, and is connected in circuit with a fuse assembly 27 (preferably slow-acting, time-delay, ¼ amp, 115 VAC as housed within an in-line screw time fuse holder) to selectively deliver power to the preferred axial fan assembly 23 via electrical conductors 28 (preferably 3-wire 14 AWG) as enshrouded within metallic armored flexible steel conduit as at 29, and directed through a conduit assembly 30 preferably comprising a ½ inch rigid Type C conduit body with cover (and gasket) as at 31 and a flexible metal conduit clamp connector (FMC) as at 32.

Figure 17:
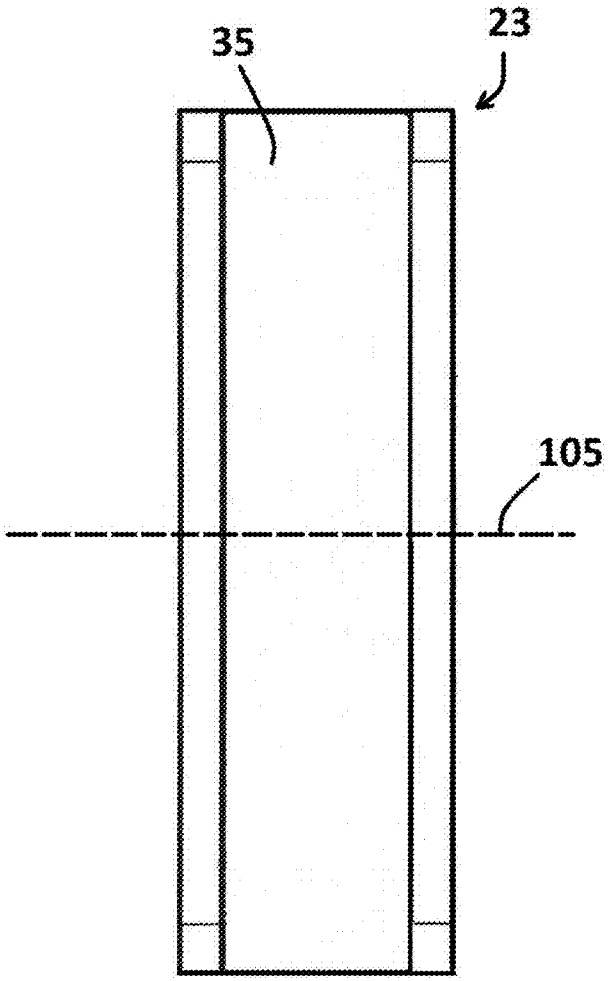
FIG. 17 is an enlarged lateral edge view of the axial fan assembly according to the present invention showing the fan housing.

The preferred axial fan assembly 23 preferably has the following basic specifications: 115 Volt Alternating Current, 4 Watts, 1 phase, 50/60 Hertz, 50 Cubic Feet per Minute, 1450 Rotations per Minute (maximum), with a noise rating of 19 decibels. Excellent results have been achieved with the ACi 4400L GreenTech EC compact fan as manufactured by: ebm-papst St. Georgen GmbH & Co. KG with current business address of Hermann-Papst-Strasse 1, D-78112, St. Georgen, Schwarzwald, Germany. The preferred axial fan assembly 23 according to the present invention is illustrated in pertinent detail in FIGS. 16 and 17.

The preferred axial fan assembly 23 according to the present invention preferably comprises in pertinent detail a fan housing as at 35, an impeller assembly as at 36, a fan motor assembly as at 37, a series of struts as at 38 for attaching the impeller and fan motor assemblies 36/37 to the fan housing 35, a power interface as at 39, and electrical conductors 40 communicating with the power interface 39 for delivering power to the fan motor assembly 37. The fan motor assembly 37 rotates the impeller assembly 36 about an axis of rotation 105 at a user-selected rotational velocity (as adjusted by the slide switch control 25) extending through a center of the impeller assembly 36 for directing airflow 106 parallel to the axis of rotation 105. The fan housing 35 is preferably mounted within the shared structural wall 19 such that the airflow 106 from the impeller assembly 36 is directed toward the structurally enclosed, first room as at 10 or 10'.

Comparatively referencing FIGS. 18-23, the reader will there consider the first and second vent covers as at 21 and 22 of the ventilation system according to the present invention. The second vent cover 22 is diagrammatically illustrated in FIGS. 18-20 and the first vent cover 21 is diagrammatically depicted in FIGS. 21-23. The first vent cover 21 is preferably attached to the first room surface 33 over a first vent aperture formed in the shared wall 19 in downstream adjacency to the preferred axial fan assembly 23 as installed within the shared wall 19 and preferably comprises a series of first louvres 41.

Figure 36A:
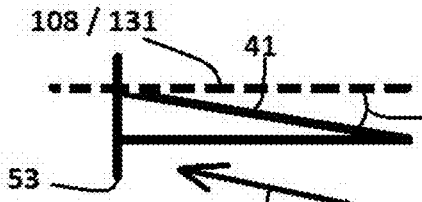
FIG. 36A is a two-dimensional diagrammatic depiction showing a preferred angle of inclination of the louvre(s) of the vent cover otherwise depicted in FIGS. 35 and 35A.
Figure 36B:
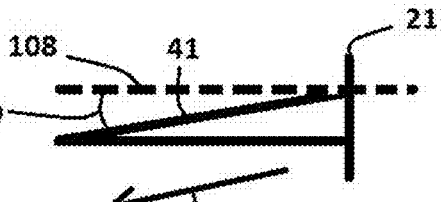
FIG. 36B is a two-dimensional diagrammatic depiction showing a preferred angle of inclination of the louvre(s) of the vent cover otherwise depicted in FIGS. 35 and 35B.

The series of louvres 41 re-direct airflow 106 from the first axial fan assembly 23 in a first oblique, downward direction 107 relative to a horizontal plane 108 parallel to the axis of rotation 105 into the first room 10 or 10'. The series of first louvres 41 are preferably angled 10 degrees downwardly (as at 109) from the horizontal plane 108 as generally depicted and referenced in FIGS. 23 and 36B. By specifically angling the louvres 41, airflow 106 is maintained within the relatively heated upper ambient temperature zone 102 for enhancing both ventilation through the first room 10 or 10' and heated characteristics of the air quality within the first cubic space 103.

The second vent cover 22 is preferably attached to the second room surface 34 over a second vent aperture formed in the shared wall 19 in upstream adjacency to the axial fan assembly 23 and preferably comprises a series of second louvres 42 for re-directing airflow 106 from the second room 18 in a second oblique, downward direction 110 relative to the horizontal plane 108 toward the axial fan assembly 23. The series of second louvres 42 are preferably angled 10 degrees upwardly (as at 111) from the horizontal plane 108 as generally depicted and referenced in FIGS. 20 and 36A. By specifically angling the louvres 42, airflow 106 is received from the uppermost portions of the relatively heated upper ambient temperature zone 102 for intaking maximally heated airflow from the second cubic space 104 thereby enhancing both ventilation through the first room 10 or 10' and heated characteristics of the air quality entering the first cubic space 103 from the second cubic space 104.

In this last regard, and in other words, the reader will note the preferred axial fan assembly 23 is mounted within the shared structural wall 19 in a relatively elevated position in adjacency to the ceiling 14 of the first room 10/10' and the ceiling 14 of the second room 18. The relatively elevated position (e.g. above the door 12) positions the first or preferred axial fan assembly 23 within the relatively warmer ambient temperature zone 102 extending within the first room 10/10' and the second room 18. The relatively elevated position of the preferred axial fan assembly 23 and the warmer ambient temperature zone 102 together maximize the temperature characteristics of the second space air 104 entering the structurally enclosed, first room(s) 10/10'.

Figure 24:
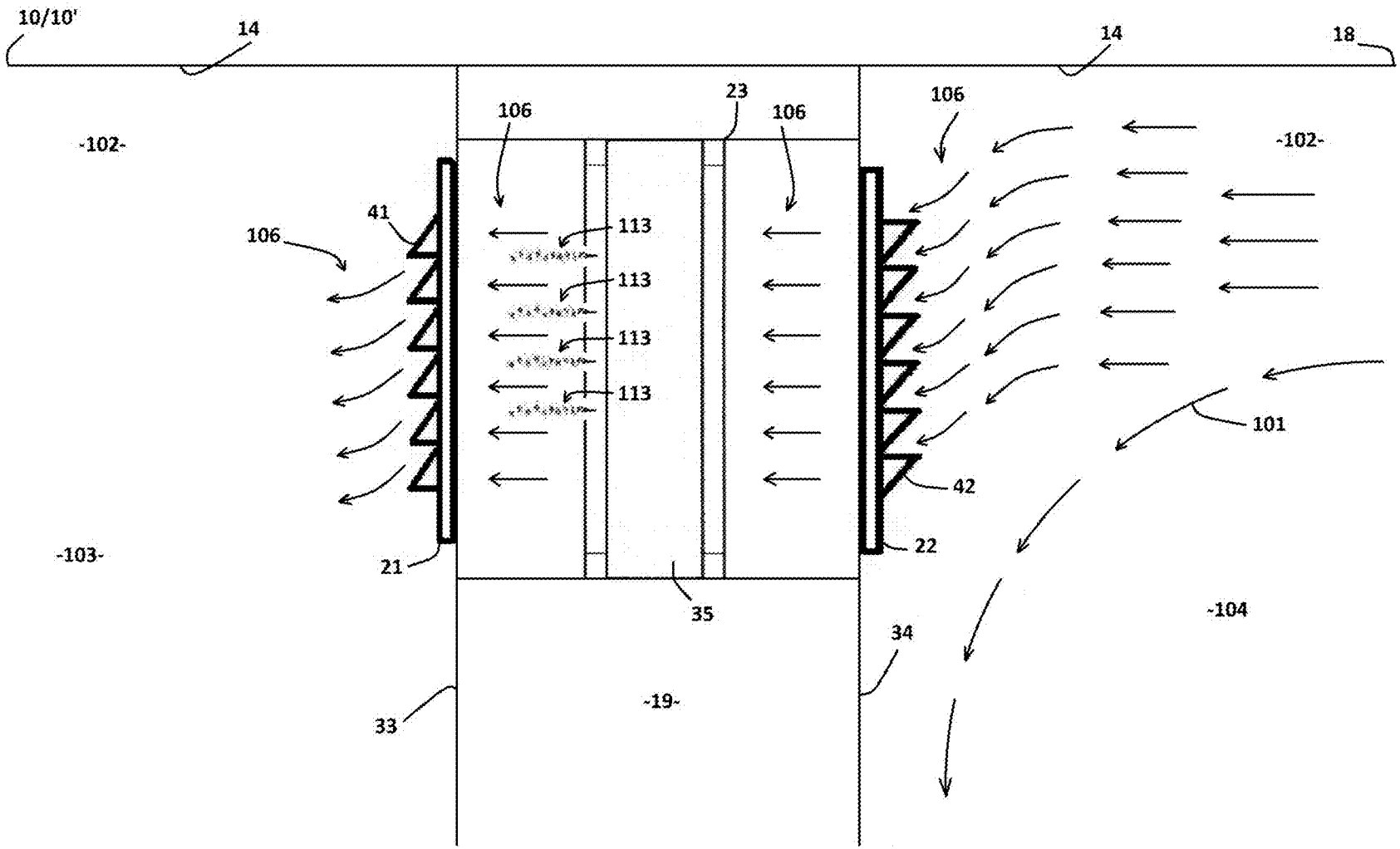
FIG. 24 is an enlarged, fragmentary diagrammatic depiction of an upper portion of the shared wall otherwise depicted in FIGS. 12 and 13 with axial fan assembly according to the present invention mounted therewithin and showing directed laminar airflow from the second room into the first room via the axial fan assembly.

Referencing FIG. 24, the reader will there further recall and consider the second room 18 may preferably provide or comprise a forced air and/or convective heat current as at 101. The forced air and/or convective heat current 101 cycles heated air toward the second vent cover 22, and has a current flow portion parallel to the second oblique, downward direction 110. The series of second louvres 42 are preferably angled 10 degrees upwardly as at 111 from the horizontal plane 108 thus for maximizing laminar airflow 106 from the second room toward the first axial fan assembly 23.

Recalling that the preferred axial fan assembly 23 is in communication with a power source as exemplified by wall-based wiring with which the slide switch 25 communicates, the ventilation system according to the present invention may be said to comprise circuitry in communication with a power source and the fan motor assembly 23. The switch 25, preferably a slide switch as specified, enables the user to selectively and adjustably power the fan motor assembly 37 at user-selected rotational velocities. The fan motor assembly 37 thereby directs airflow 106 from the second room 18 into the first room(s) 10/10' for replacing the air within the first cubic space 103 (and its relatively inferior first air quality) with air from the second cubic space 104 (and its relatively superior second air quality). The ventilation system according to the present invention thus ventilates the structurally enclosable first room 10/10'.

Figure 25:
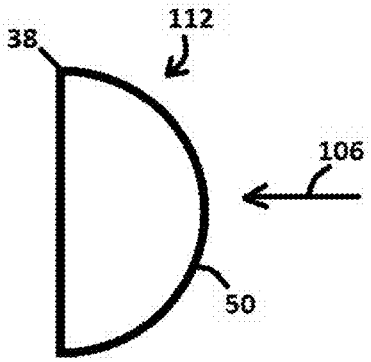
FIG. 25 is an enlarged cross-sectional type diagrammatic depiction of a strut element of the axial fan assembly according to the present invention.
Figure 26:
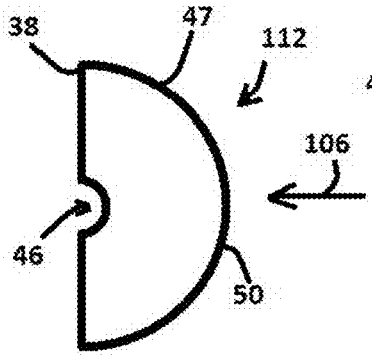
FIG. 26 is an enlarged cross-sectional view a grooved strut element of the axial fan assembly according to the present invention.
Figure 27:
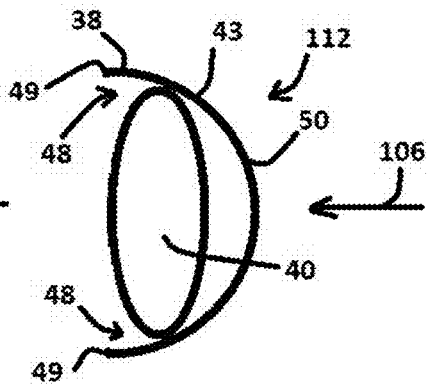
FIG. 27 is an enlarged cross-sectional view a strut shroud element enshrouding an inner power-delivering conductor of the axial fan assembly according to the present invention.
Figure 28:
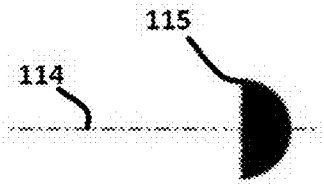
FIG. 28 is a diagrammatic depiction of a generic semicircular obstruction axially aligned in a directed airflow.
Figure 28:
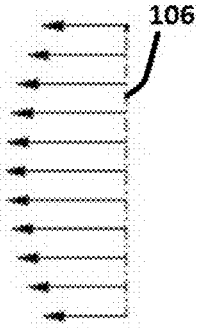
Figure 29:
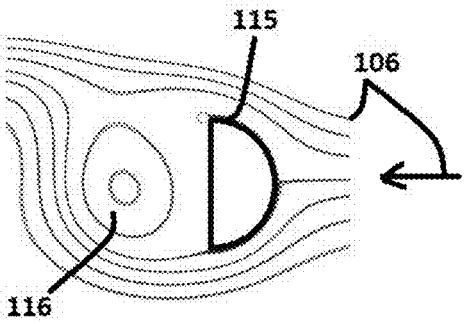
FIG. 29 is a diagrammatic depiction of a swirling vortex formed downstream from directed airflow past the semicircular cross-section of a strut element of the axial fan assembly according to the present invention.

Recalling that the preferred axial fan assembly 23 preferably comprise a series of struts 38 for holding the impeller and fan motor assemblies 36 and 37 to the fan housing 35, the series of struts 38 are preferably each defined by comprising a semicircular cross-section 112 as generally depicted and referenced in FIGS. 25-27. Each semicircular cross-section 112 comprises a 180-degree full arc portion as at 50, and each full arc portion 50 opposes the direction of the airflow 106 from the impeller assembly 36. The preferred axial fan assembly 23 may thus be characterized as an exhaust-over-strut type fan assembly.

Figure 16:
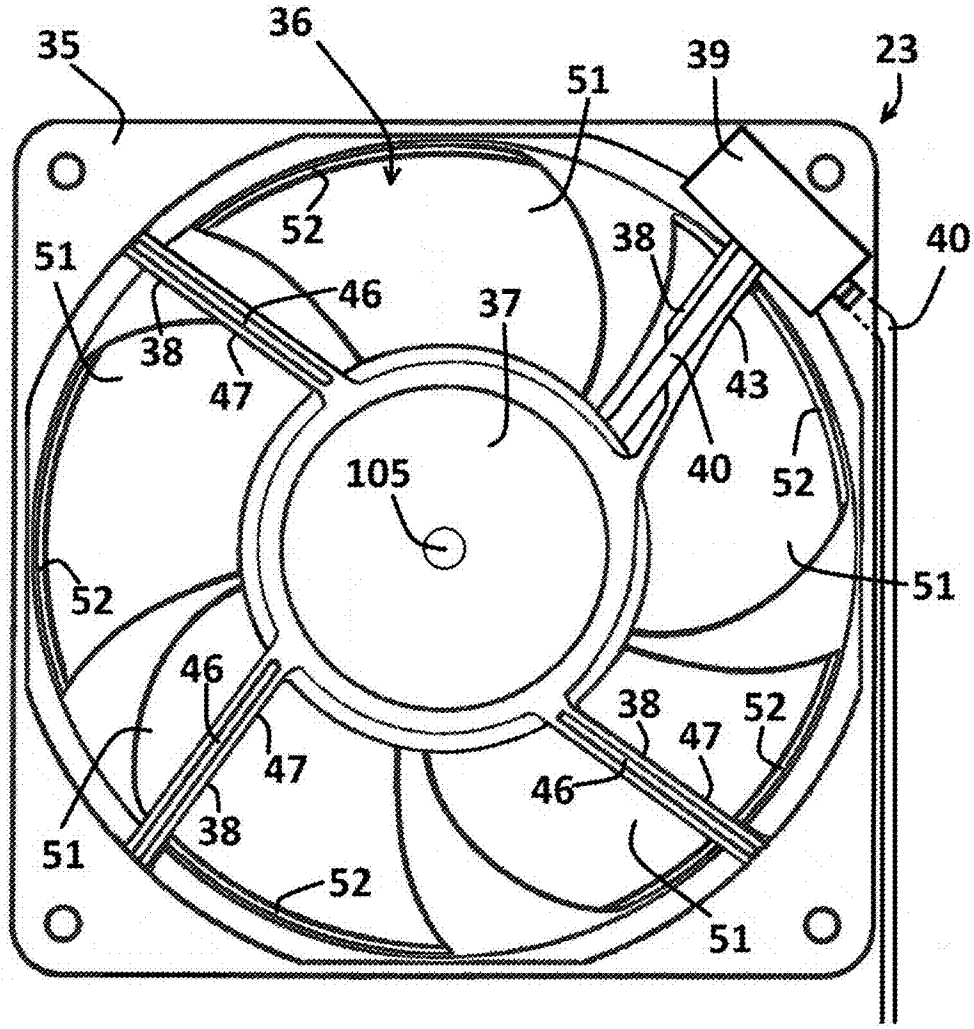
FIG. 16 is an enlarged detailed anterior plan view of an axial fan assembly according to the present invention showing a fan housing, an impeller assembly, a fan motor assembly, and a series of struts attaching the fan motor assembly to the fan housing.

Comparatively referencing FIGS. 16 and 27, the reader will note that a select strut of the series of struts 38 is a shroud strut as at 43. The shroud strut 43 is a hollow shroud type element and covers or enshrouds an electrical conductor element 40 communicating the power interface 39

(mounted within the fan housing assembly 35) and the fan motor assembly 37. Comparatively referencing FIGS. 16, 26, and 27, the reader will note that the series of struts 38 each preferably comprise a void region opposite the full arc portion 50. The void regions may be defined by grooves or groove voids 46 as formed in the non-shrouding struts 47, and those open irregular void portions 48 extending anteriorly from the electrical conductor element 40 to the shroud edges 49 of the shroud strut 43. The series of groove voids 47 together volumetrically approximate the irregular void portions 48 of the shroud struts for balancing patterned turbulence within the regions of vortex shedding.

Noting that the series of struts 38 with semicircular cross-sections 112 oppose the airflow 106 in a preferred exhaust-over-strut arrangement or configuration, the impeller assembly 36 preferably forms regions of vortex shedding as diagrammatically depicted and referenced at 113 in FIG. 24. The regions of vortex shedding 113 downstream from the series of struts 38 may thus be said to increase patterned turbulence (or repeating pattern of swirling vortices—i.e. a Kármán vortex street) in the airflow 106 downstream from the preferred axial fan assembly 23. The increase patterned turbulence mixes air within the laminar airflow 106 thereby enhancing second air quality of the airflow 106 entering the structurally enclosable first room(s) 10/10' from the second room 18.

Figure 30:
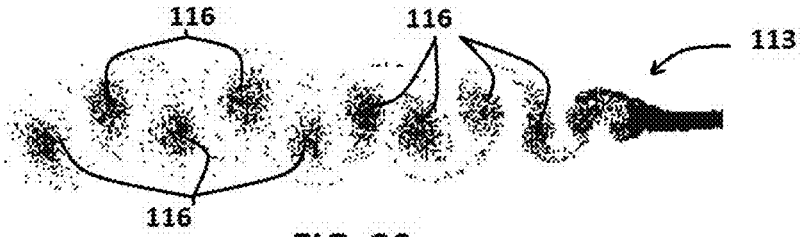
FIG. 30 is a diagrammatic depiction of a repeating pattern of swirling vortices indicate of vortex shredding downstream from a semicircular obstruction in a directed airflow.

In this last regard, the reader will comparatively reference FIGS. 24, and 28 through 32. As a directed airflow 106 approaches a semicircular obstruction 115 in the path or axis 114 of the flow, a vortex 116 is formed downstream from the obstruction 115 as comparatively depicted in FIGS. 28 and 29. Continual airflow 106 produces a repeating pattern of swirling vortices 116 as generally depicted in FIG. 30 depicting a Kármán vortex street or repeating pattern of swirling vortices 116.

Figure 31:
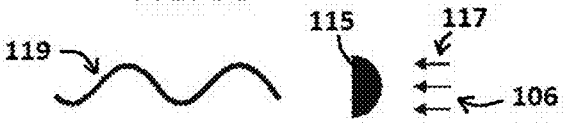
FIG. 31 is a frequency diagram of the repeating pattern of swirling vortices downstream from a semicircular obstruction in a directed airflow having a first, relatively reduced velocity.
Figure 32:
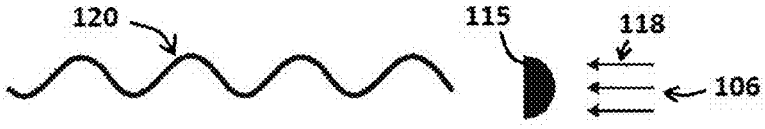
FIG. 32 is a frequency diagram of the repeating pattern of swirling vortices downstream from a semicircular obstruction in a directed airflow having a second, relatively increased velocity.
Figure 33:
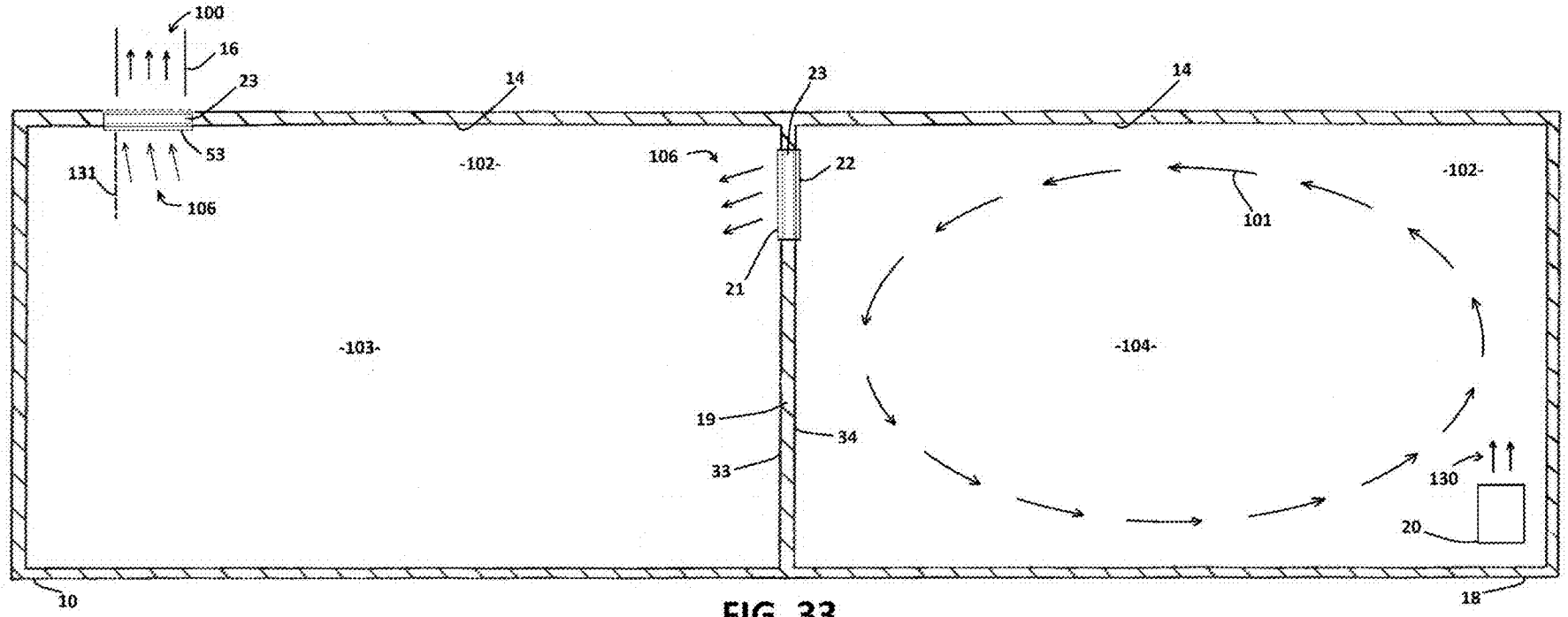
FIG. 33 is a cross-sectional type diagrammatic depiction of a first room adjoining a second room having a shared wall therebetween with axial fan assemblies according to the present invention installed in the ceiling of the first room and the shared wall for exhausting air from the second room into the first room, and exhausting air from the first room, the second room comprising a convective heat current.

Airflow 106 having a first, relatively lesser velocity is depicted at arrows 117 in FIG. 31, and airflow 106 having a second, relatively greater velocity is depicted at arrows 118 in FIG. 32. Airflow velocity is directly proportional to pattern frequency per the general equation: pattern frequency (f)=[St (x) (Airflow velocity (V)]/(Diameter (D)) where St is a constant and Diameter (D) is the diameter of the obstruction 115. It will thus be seen that the pattern frequency 119 depicted in FIG. 31 is less than the pattern frequency 120 depicted in FIG. 32. The user may thus fine tune the regions of patterned turbulence by adjusting the variable airflow velocity by way of the slide switch 25. Each void region is believed to further affecting vortex shedding patterns and the grooves 46 formed in the three (3) non-shrouding struts 47 help balance the void portions 48 of the shroud strut 43 and further balance void-based turbulence in the airflow 106 from the preferred axial fan assembly 23.

Recalling the switch 25 is preferably adjustable for enabling the user to adjust power delivery to and rotational velocity of the fan motor assembly 37, the reader will note that airflow 106 velocity from the impeller assembly 36 is dependent upon rotational velocity of the fan motor assembly 37. Further, characteristics of the patterned turbulence are further dependent upon airflow 106 velocity. The switch 25 thereby further enables the user to fine tune airflow 106 characteristics of the first axial fan assembly vis-á-vis the regions of vortex shedding 113. Noting also that the preferred axial fan assembly 23 comprises an impeller assembly 36 having a series of blades 51, the reader will further note that each blade 51 preferably comprises an outer blade winglet as at 52. The outer blade winglets 52 further enhance airflow characteristics and reduce noise.

Comparatively referencing FIGS. 33-36B, the reader will there further consider the ventilation system according to the present invention wherein the first ventilation assembly may be preferably outfitted with a first ventilation vent cover as at 53 substantially identical to the first vent cover 21. The first ventilation vent cover 53 thus also preferably comprises a series of first ventilation louvres 41 for re-directing airflow 106 in a first oblique direction relative to the plane 131 orthogonal to the plane of the vent cover 53. In this regard, the series of first ventilation louvres 41 are preferably angled 10 degrees relative to the plane 131 orthogonal to plane of the vent cover 53. The first ventilation assembly may further be preferably outfitted or replaced with a select axial fan assembly, which select axial fan assembly is substantially identical to the preferred or first axial fan assembly 23.

Figure 34:
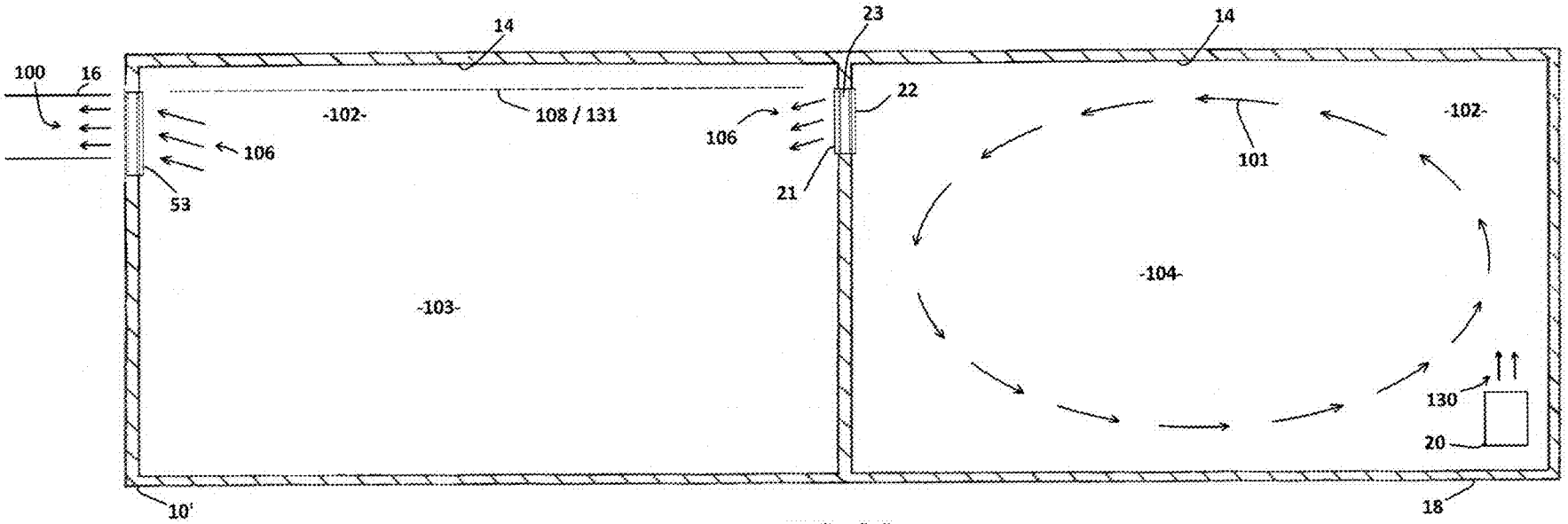
FIG. 34 is a cross-sectional type diagrammatic depiction of a first room adjoining a second room having a shared wall therebetween with axial fan assemblies according to the present invention installed in a wall of the first room and the shared wall for exhausting air from the second room into the first room, and exhausting air from the first room, the second room comprising a convective heat current.
Figure 35:
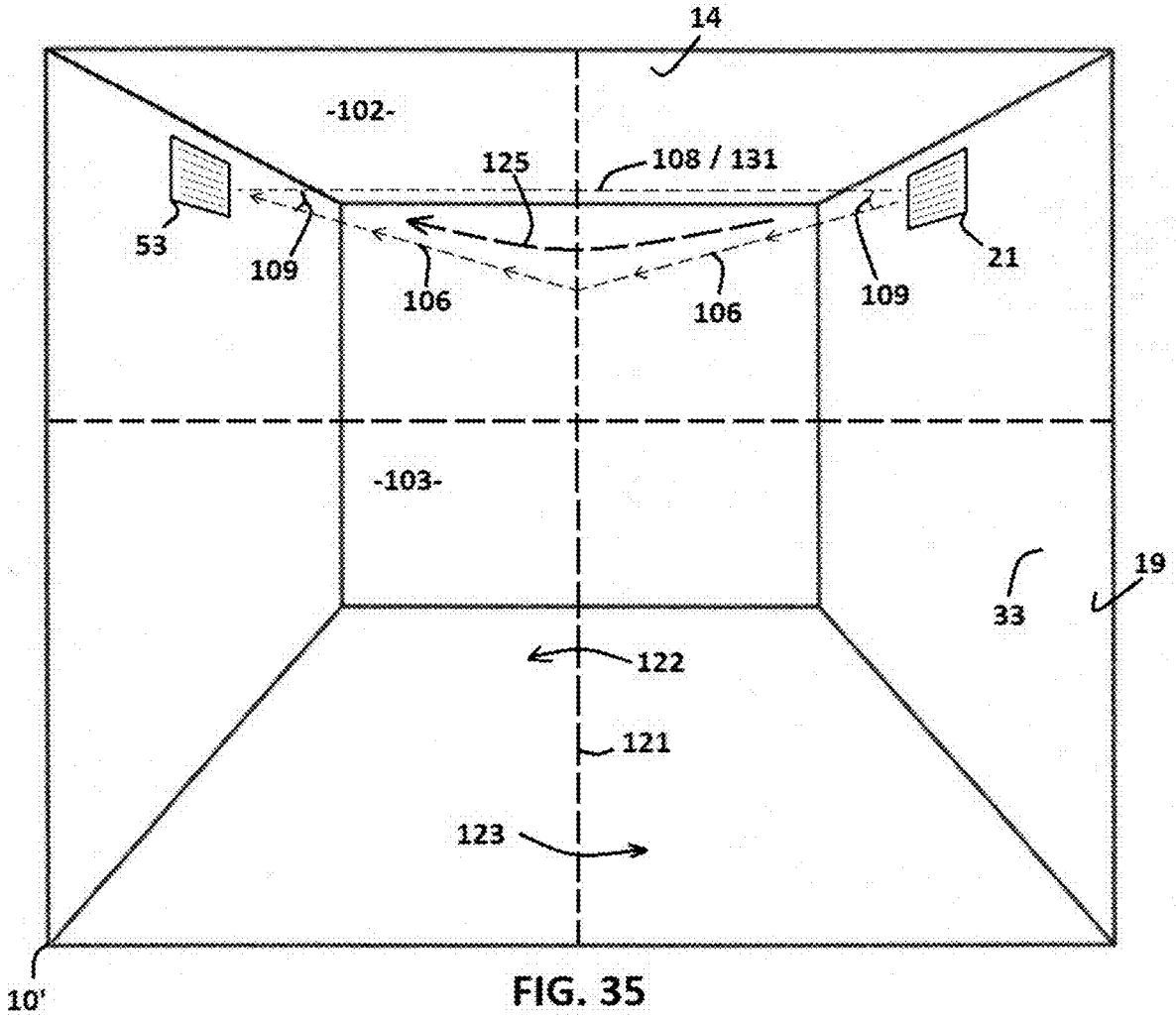
FIG. 35 is a perspective type diagrammatic depiction of a first room outfitted with opposed vent covers with specified louvres according to the present invention, the left vent cover covering a vent outlet and directing exhausting airflow by way of a specified angle and the right vent cover covering a vent inlet from an adjoining second room and directing incoming airflow by way of the specified angle.
Figure 35A:
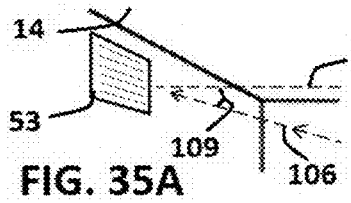
FIG. 35A is a fragmentary sectional view as sectioned from FIG. 35 to depict the left vent cover covering the vent outlet for directing exhausting airflow by way of the specified angle.
Figure 35B:
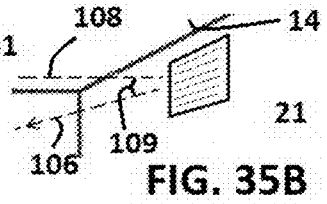
FIG. 35B is a fragmentary sectional view as sectioned from FIG. 35 to depict the right vent cover covering the vent outlet for directing incoming airflow by way of the specified angle.

When the vent covers 53/21 and select axial fan assembly, exemplified by the preferred axial fan assembly 23, is installed in the first room as at 10', the configuration is generally and comparatively depicted in FIGS. 34 and 35. Comparatively referencing FIGS. 34 and 35, the reader will there see that airflow from vent cover 21 into the first room 10' is angled 10 degrees downwardly as at 109 from the horizontal plane 108. Referencing FIG. 36A, airflow intake 124 at vent cover 53 is angled upwardly at 10 degrees from the horizontal plane 108 thereby forming an arcuate path of ventilation 125 through the first room 10' through the relatively warmer or heated ambient temperature zone 102 and symmetrical about a longitudinal plane 121 dividing the first room 10' into a left or airflow exhaust room half 122 and a right or airflow intake room half 123 for enhancing ventilation characteristics of the ventilation system according to the present invention.

While the above descriptions contain much specificity, this specificity should not be construed as limitations on the scope of the invention, but rather as an exemplification of the invention. Accordingly, although the room ventilation system according to the present invention has been described by reference to a number of different structural features and functions, it is not intended that the novel systemic aspects be limited thereby, but that modifications thereof are intended to be included as falling within the broad scope and spirit of the foregoing disclosure, the appended drawings, and the following claims.

What is claimed is:

1. A room ventilation system, the room ventilation system comprising:

a structurally enclosable first room, the structurally enclosable first room defining a first cubic space and being outfitted with a first ventilation assembly, the first ventilation assembly for directing air from within the first cubic space out of the first cubic space, the air within the first cubic space having a first, relatively inferior air quality;

a second room, the second room adjoining the structurally enclosable first room and having a shared wall with the structurally enclosable first room, the shared wall comprising a first room surface within the structurally enclosable first room and a second room surface within the second room, the second room defining a second cubic space, the air within the second cubic space having a second, relatively superior air quality;

a first axial fan assembly, the first axial fan assembly comprising a fan housing, an impeller assembly, and a fan motor assembly, the fan motor assembly for rotating the impeller assembly about an axis of rotation extending through a center of the impeller assembly for directing airflow parallel to the axis of rotation, the fan housing being mounted within the shared wall such that the airflow from the impeller assembly is directed toward the structurally enclosable first room;

a first vent cover, the first vent cover being attached to the first room surface over a first vent aperture in downstream adjacency to the first axial fan assembly and comprising a series of first louvres for re-directing airflow from the first axial fan assembly in a first oblique, downward direction relative to a horizontal plane parallel to the axis of rotation into the structurally enclosable first room, the series of first louvres being angled 10 degrees downwardly from the horizontal plane;

a second vent cover, the second vent cover being attached to the second room surface over a second vent aperture in upstream adjacency to the first axial fan assembly and comprising a series of second louvres for re-directing airflow from the second room in a second oblique, downward direction relative to the horizontal plane toward the first axial fan assembly, the series of second louvres being angled 10 degrees upwardly from the horizontal plane; and circuitry, the circuitry being in electrical communication with a power source and the fan motor assembly and comprising a switch for enabling the user to selectively power the fan motor assembly, the fan motor assembly directing airflow from the second room into the structurally enclosable first room for replacing air within the first cubic space with air from the second cubic space, the ventilation system thus for ventilating the structurally enclosable first room.

2. The room ventilation system of claim 1 wherein the first axial fan assembly is mounted within the shared wall in a relatively elevated position in adjacency to a first ceiling of the first room and a second ceiling of the second room, the relatively elevated position for positioning the first axial fan assembly within a heated ambient temperature zone within the first room and the second room, the relatively elevated position of the first axial fan assembly and the heated ambient temperature zone for maximizing temperature of the air entering the structurally enclosable first room from the second room.

3. The room ventilation system of claim 2 wherein the second room comprises a cyclic heat current, the cyclic heat current cycling heated air toward the second vent cover, the cyclic heat current having a current flow portion parallel to the second oblique, downward direction, the series of second louvres, being angled 10 degrees upwardly from the horizontal plane, for maximizing laminar airflow from the second room toward the first axial fan assembly.

4. The room ventilation system of claim 1 wherein the first axial fan assembly comprise a series of struts for holding the impeller assembly and the fan motor assembly to the fan housing, the series of struts each comprising a semicircular cross-section, each semicircular cross-section comprising a full arc portion, each full arc portion opposing the direction of airflow from the impeller assembly.

5. The room ventilation system of claim 4 wherein the series of struts with semicircular cross-sections oppose the airflow from the impeller assembly thereby forming regions of vortex shedding in the airflow downstream from the series of struts, the regions of vortex shedding for increasing patterned turbulence within the airflow from the first axial fan assembly, the increased patterned turbulence for mixing air within laminar airflow and enhancing characteristics of air entering the structurally enclosable first room.

6. The room ventilation system of claim 5 wherein a select strut of the series of struts is a shroud strut, the shroud strut for covering electrical circuitry extending intermediate the fan housing and the fan motor assembly.

7. The room ventilation system of claim 6 wherein the series of struts each comprise a void region opposite the full arc portion, each void region for affecting vortex shedding patterns within the airflow from the first axial fan assembly.

8. The room ventilation system of claim 7 wherein the series of struts comprise a series of grooved struts, the grooved struts each comprising a groove void, the groove voids of the series of grooved struts together volumetrically approximating irregular void portions of the shroud strut for balancing patterned turbulence within the regions of vortex shedding.

9. The room ventilation system of claim 8 wherein the switch is adjustable for enabling the user to adjust power delivery to and rotational velocity of the fan motor assembly, airflow velocity from the impeller assembly being dependent upon rotational velocity of the fan motor assembly, characteristics of the patterned turbulence being dependent upon airflow velocity, the switch thereby further enabling the user to fine tune airflow characteristics of the first axial fan assembly vis-á-vis the regions of vortex shedding.

10. The room ventilation system of claim 9 wherein the impeller assembly comprises a series of blades, each blade comprising an outer blade winglet, the outer blade winglets for enhancing airflow characteristics of the first axial fan assembly.

11. The room ventilation system of claim 1 wherein the first ventilation assembly comprises a first ventilation vent cover, the first ventilation cover extending in a vent cover plane and comprising a series of first ventilation louvres for re-directing airflow therethrough in a first oblique direction relative to a plane orthogonal to the vent cover plane, the series of first ventilation louvres being angled 10 degrees the plane orthogonal to the vent cover plane.

12. The room ventilation system of claim 11 wherein the first ventilation assembly comprises a select axial fan assembly, the select axial fan assembly being the same as the first axial fan assembly.

13. The room ventilation system of claim 12 wherein airflow from the first vent cover is directed into the first room angled 10 degrees downwardly the horizontal plane, and the airflow into the first ventilation vent cover is angled upwardly at 10 degrees from the horizontal plane thereby forming an arcuate path of ventilation through the first room within the relatively warmer ambient temperature zone and symmetrical about a longitudinal plane dividing the first room into an airflow exhaust room half and an airflow intake room half for enhancing ventilation characteristics of the ventilation system according to the present invention.

* * * * *